US005685242A

United States Patent [19]

Narato et al.

[11] Patent Number: 5,685,242

[45] Date of Patent: Nov. 11, 1997

[54] PULVERIZED COAL COMBUSTION BURNER

[75] Inventors: Kiyoshi Narato, Ibaraki-ken; Hironobu Kobayashi, Hitachinaka; Masayuki Taniguchi, Hitachinaka; Tsuyoshi Kohno, Hitachinaka; Hirofumi Okazaki, Hitachi; Kazuyuki Ito, Hitachinaka; Shigeki Morita, Hiroshima; Akira Baba, Kure, all of Japan

[73] Assignees: Hitachi, Ltd.; Babcock-Hitachi Kabushiki Kaisha, both of Tokyo, Japan

[21] Appl. No.: 406,029

[22] Filed: Mar. 17, 1995

[30] Foreign Application Priority Data

Mar. 18, 1994 [JP] Japan ..... 6-048246

[51] Int. Cl.[6] ..... F23C 1/10

[52] U.S. Cl. ..... 110/262; 110/264; 110/265; 110/104 B

[58] Field of Search ..... 110/260–262, 264, 110/265, 104 B; 431/182–185, 168, 172, 187

[56] References Cited

U.S. PATENT DOCUMENTS

| | | | |
|---|---|---|---|
| 4,412,810 | 11/1983 | Izuha aet al. | 110/261 X |
| 4,807,541 | 2/1989 | Masai et al. | 110/262 |
| 5,090,339 | 2/1992 | Okiura et al. | 110/265 X |
| 5,199,355 | 4/1993 | Larue | 110/261 |

FOREIGN PATENT DOCUMENTS

| | | |
|---|---|---|
| 0 409 102 | 1/1991 | European Pat. Off. . |
| 2 580 379 | 10/1986 | France . |
| 2-110202 | 10/1988 | Japan . |
| 1-305206 | 3/1989 | Japan . |
| 3-50408 | 3/1991 | Japan . |
| 3-110308 | 5/1991 | Japan . |
| 3-211304 | 9/1991 | Japan . |

OTHER PUBLICATIONS

Patent Abstracts of Japan, vol. 015, No. 489 (m–1189) 11 Dec. 1991.

Patent Abstracts of Japan, vol. 015, No. 303 (M–1142) 2 Aug. 1991.

Patent Abstracts of Japan, vol. 009, No. 117 (M–381), 22 May 1985.

Patent Abstracts of Japan, vol. 009, No. 111 (M–379), 15 May 1985.

*Primary Examiner*—Henry A. Bennett
*Assistant Examiner*—Susanne C. Tinker
*Attorney, Agent, or Firm*—Antonelli, Terry, Stout & Kraus, LLP

[57] ABSTRACT

A pulverized coal combustion burner includes a pulverized coal nozzle, and secondary and tertiary air nozzles provided in concentric relation to the pulverized coal nozzle. A flame stabilizing ring is provided at an outlet end of the pulverized coal nozzle. A separation wall is provided within the pulverized coal nozzle to divide a passage in this nozzle into two passages. A pulverized coal/air mixture flows straight through the two passages, so that recirculation flows of the pulverized coal/air mixture are formed in proximity to the outlet end of the pulverized coal nozzle. As a result, the ignitability of the pulverized coal, as well as a combustion rate, is enhanced, thereby reducing the amount of discharge of NOx.

43 Claims, 13 Drawing Sheets

PULVERIZED COAL COMBUSTION BURNER

FIELD OF THE INVENTION AND RELATED ART STATEMENT

This invention relates to a pulverized coal combustion burner.

An extensive study of the construction of pulverized coal combustion burners has been made in order to reduce the amount of production of nitrogen oxides (NOx) from a coal burning boiler or a coal combustion furnace which uses the pulverized coal combustion burner.

One such known pulverized coal combustion burner comprises a pulverized coal nozzle for injecting a coal/primary air mixture, and secondary and tertiary nozzles, and such a construction is disclosed in Japanese Patent Unexamined Publication Nos. 1-305206, 2-110202, 3-211304 and 3-110308.

Japanese Patent Unexamined Publication No. 1-305206 describes a construction in which a plurality of turbulence-forming members are provided at an outlet end portion of a pulverized coal nozzle so as to stabilize a flame. Japanese Patent Unexamined Publication Nos. 3-211304 and 3-110308 describe a construction in which a flame stabilizing ring is provided at a distal end of a pulverized coal nozzle so as to stabilize a flame. Japanese Patent Unexamined Publication Nos. 3-211304, 3-50408 and 3-241208 show burners into which fuel is supplied with enhancing a concentration of pulverized coal in the fuel.

When the pulverized coal combustion burner is constituted by the pulverized coal nozzle for injecting a coal/primary air mixture and the secondary and tertiary nozzles which are arranged concentrically, a reducing flame region and an oxidizing flame region can be formed in the flame, so that the amount of production of NOx can be kept to a low level. By providing the flame stabilizing ring or the turbulence-forming members at the distal end portion of the pulverized coal nozzle, the ignitability of the pulverized coal, as well as the flame stability, can be enhanced.

However, coal itself is poor in ignitability, and therefore if a certain amount of coal particles are not contained in the coal/primary air mixture, ignition does not take place at all, or hardly takes place. Therefore, in a thermal power generation plant using coal, the combustion can not be effected only by coal when the load is low, and hence the output is low, and therefore an oil gun is used to assist in the combustion, and when the load becomes high, the combustion is switched to the only coal combustion. In the case of an ordinary power plant, the minimum load which can be dealt with only by the coal combustion is about 40%.

Therefore, NOx is liable to be produced when the load is low.

OBJECT AND SUMMARY OF THE INVENTION

It is an object of this invention to provide a pulverized coal combustion burner which can burn coal even under a low load so as to form a good flame, while suppressing the production of NOx.

To this end, according to the present invention, there is provided a pulverized coal combustion burner comprising:

- a pulverized coal passage through which a coal/air mixture containing pulverized coal and the air;
- an air passage for supplying the air to a flow of the coal/air mixture from outside;
- a partition wall separating the pulverized coal passage from the air passage;

- first recirculation flow-forming means provided at a downstream end of the partition wall for forming recirculation flows of the coal/air mixture and the air;
- a separation wall provided within the pulverized coal passage for dividing the coal/air mixture flow into two straight flows; and
- second recirculation flow-forming means for forming recirculation flows of the coal/air mixture downstream of a downstream end of the separation wall.

The foregoing and other objects, features and advantages of the invention will be made clearer from description hereafter of preferred embodiments with reference to attached drawings.

DETAILED DESCRIPTION OF THE PREFERRED EMBODIMENTS

Figure 1:
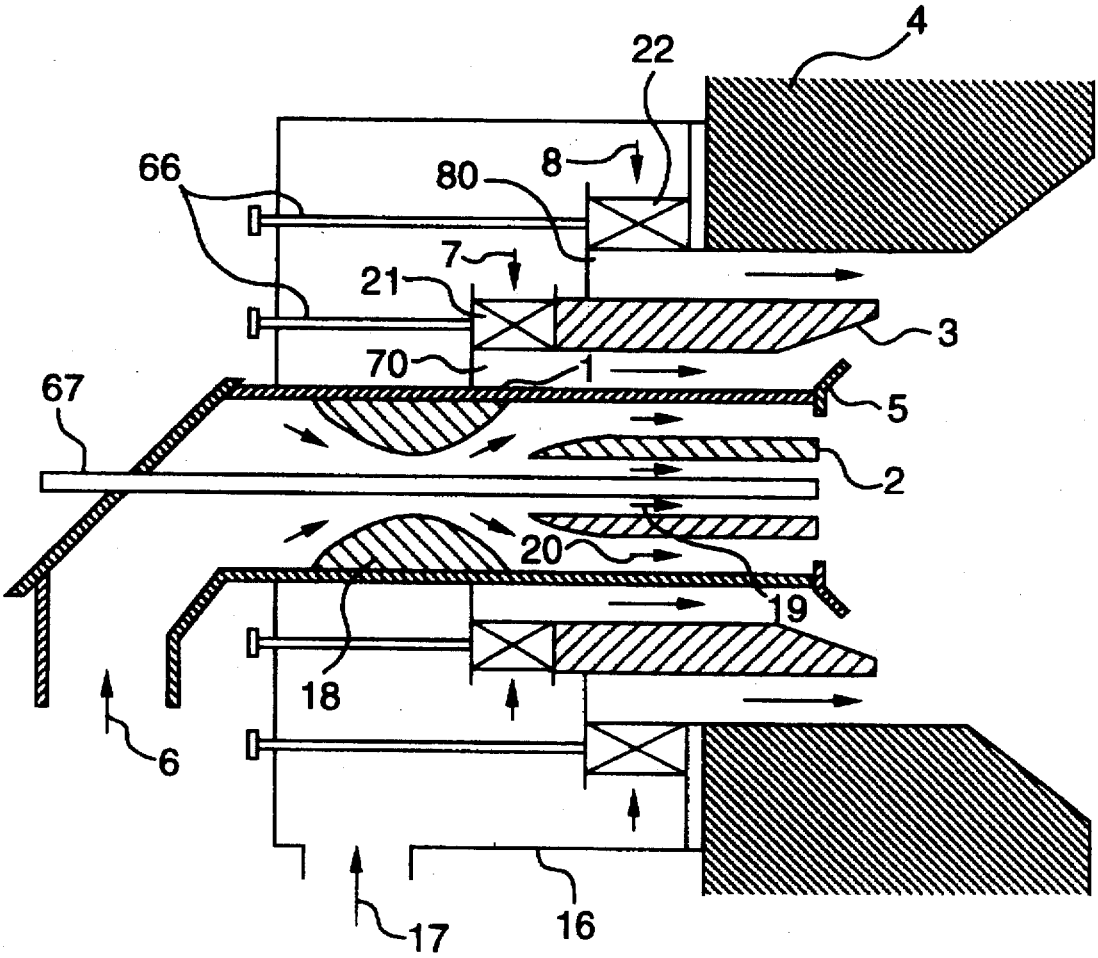
FIG. 1 is a cross-sectional view showing a pulverized coal burner according to one embodiment of the present invention mounted in a furnace wall.

FIG. 1 shows one preferred embodiment of a pulverized coal combustion burner of the present invention provided in a burner throat in a side wall of a furnace.

The burner of this embodiment comprises an annular pulverized coal nozzle 1 for injecting a mixture 6 of coal particles and primary air carrying the coal particles into the furnace, and a secondary air nozzle 70 for injecting secondary air 7, and a tertiary air nozzle 80 for injecting tertiary air 8. The secondary and tertiary air nozzles 70 and 80 are arranged around the pulverized coal nozzle 1 in concentric relation thereto. In this embodiment, an oil gun 67 extends through the pulverized coal nozzle 1 so as to assist in combustion at the time of igniting the coal and when the load is low. Combustion air 17, serving as the secondary and tertiary air, is introduced into a wind box 16, and is changed by swirl devices 21 and 22 into swirls which are to be injected from the secondary and tertiary nozzles 70 and 80, respectively. The swirl devices 21 and 22 comprise register vanes. A passage through which the tertiary air flows is an annular passage defined by a spacer 3 and a furnace wall 4. A passage through which the secondary air flows is an annular passage formed by a wall of the pulverized coal nozzle 1 and the spacer 3. The angle of the vanes of the swirl devices 21 and 22 can be adjusted by opening-degree adjustment rod 66, so that the intensity of the swirls of the secondary and tertiary airs can be changed. A flame stabilizing ring 5 is mounted on an outlet end of the pulverized coal nozzle 1. The flame stabilizing ring 5 has a first surface (or wall) perpendicular to the direction of flow of the coal particles, and a second surface (or wall) flaring from an outer periphery of this first surface in a downstream direction. The flame stabilizing ring 5 has a generally L-shaped transverse cross-section. When the inner periphery of the first surface is projected radially inwardly from the peripheral wall of the pulverized coal nozzle 1 as shown in the drawings, there is achieved an advantageous effect that recirculation flows of the coal particles/air mixture are liable to be formed downstream of this first surface.

The pulverized coal nozzle 1 is connected to a feed pipe (not shown) for the coal particles. A throat 18 is formed on an inner peripheral surface of the pulverized coal nozzle 1 to reduce an inner diameter thereof. A flow of the coal particles is throttled by this throat 18, and directed toward the nozzle outlet. The coal particle flow is throttled by the throat 18 and then two flows different in particle size distribution are formed downstream of this throat. More specifically, a mixture, containing a relatively large amount of coarse pulverized coal of a large inertia force, flows at a central portion of the pulverized coal nozzle 1 whereas a mixture, containing a relatively large amount of fine pulverized coal, flows at an outer peripheral portion of the pulverized coal nozzle 1. The two flows, that is, the coarse pulverized coal flow and the fine pulverized coal flow, are kept straight up to the injection port or outlet of the pulverized coal nozzle 1 by an annular separation wall 2 provided downstream of the throat 18 in the pulverized coal nozzle 1.

The primary air serves to transfer the coal particles, and also serves as part of the coal combustion air. The secondary air makes up the air necessary for igniting the coal particles. The tertiary air is applied so that the amount of the sum of the primary, secondary and tertiary airs can be an amount of air (usually called "theoretical amount of air) necessary for the complete combustion of the coal. Actually, preferably, the amount of the sum of the primary, secondary and tertiary airs is slightly larger than the theoretical amount of the air. A total of the three airs is supplied in an amount about 1.2 times larger than the theoretical amount of the air, thereby effecting the combustion in an air-excessive condition. In an ordinary burner, the ratio of the primary air to the theoretical amount of the air is kept somewhat low so as not to cause the spontaneous ignition of coal particles, and is generally kept to about 0.25 and to 20%–25% of the total air amount. In the present invention, also, this should be adopted. Preferably, the amount of the secondary air is 15%–30% of the total air amount, and the remainder is supplied from the tertiary air nozzle.

The operation and effects of this embodiment will now be described hereinafter with reference to FIGS. 1 and 2.

The mixture 6 of the coal particles and the primary air, introduced into the pulverized coal nozzle 1, flows straight in this nozzle 1. The flow of the mixture 6 is concentrated at the throat 18, and is again expanded past this throat 18. At this time the mixture flow 6 is classified by the inertia force thereof into a group of coarse pulverized coal, flowing at the central portion, and a group of fine pulverized coal (which is liable to be entrained in a stream) flowing adjacent to the inner peripheral surface of the nozzle 1. The passage within the nozzle 1 is divided or partitioned by the annular separation wall 2 into an outer annular passage and an inner cylindrical passage. An outer mixture flow 20, containing a mixture of a larger amount of fine coal particles and the primary air, flows through the outer annular passage, while an inner mixture flow 19, containing a mixture of a larger amount of coarse coal particles and the primary air, flows through the inner cylindrical passage.

Figure 2:
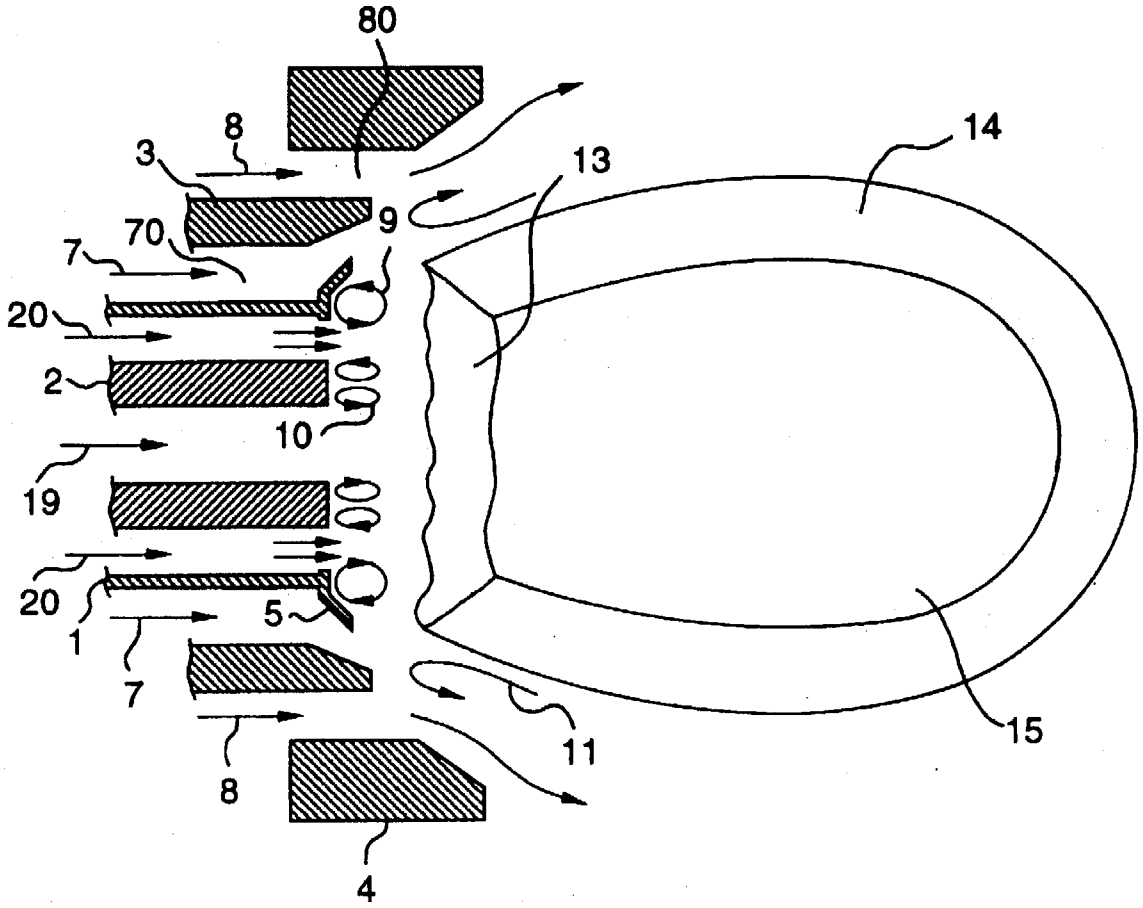
FIG. 2 is a schematic view showing a flame formed by the burner of FIG. 1.
Figure 2A:
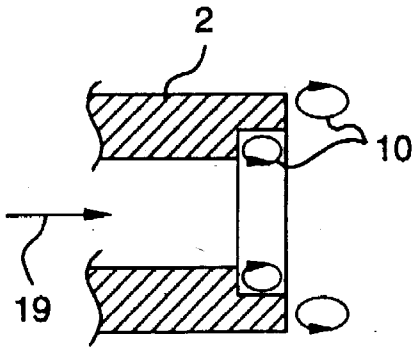
FIG. 2A is a fragmentary cross-sectional view of a modified separation wall.

Recirculation flows 9 are generated downstream of the flame stabilizing ring 5 by this flame stabilizing ring 5 provided at an outlet of the outer passage of the pulverized coal nozzle 1, as shown in FIG. 2. The coal particles flow into the recirculation flows 9. The pulverized coal including a larger amount of fine coal particles flows through the outer passage and therefore the concentration of the pulverized coal in the recirculation flows 9 increases, thereby enhancing the ignitability. Moreover, since the mixture, containing the coal particles, is injected in a straight flow, the coal particles are prevented from being dispersed outwardly, and recirculation flows 10 are also formed downstream of a distal end of the separation wall 2 having a radial wall thickness of 10 mm. Therefore, the concentration of the coal particles at this portion is also increased, thereby further enhancing the ignitability. In this connection, a structure of the separation wall 2 shown in FIG. 2A is also preferable for this purpose. These effects are further enhanced by providing the spacer 3 between the secondary air nozzle 70 and the tertiary air nozzle 80 and by injecting the tertiary air in swirls to cause this air to have a radial outward velocity component. The reason for this is that the flow downstream of the spacer 3 has a negative pressure, so that recirculation flows of hot (high-temperature) combustion gas 11 are formed in proximity to the spacer 3. As a result, an ignition region 13 of an enhanced ignitability is formed immediately adjacent to the outlet of the burner. The amount of the coarse pulverized coal in the inner passage of the pulverized coal nozzle 1 is larger. However, since the ignitability of the pulverized coal at the outlet of the outer passage of the pulverized coal nozzle 1 is enhanced, there is achieved an advantageous effect that the heating rate of the coarse pulverized coal injected from the inner passage is increased, so that the combustion efficiency of the coal particles (including a larger amount of coarse pulverized coal) at the central portion can be kept high.

As a result, a large region of a fuel rich reducing flame 15 is formed at a central portion of the flame, and a region of an air rich oxidizing flame 14 is formed to surround the reducing flame 15. In the oxidizing flame region, a combustion reaction occurs actively, and therefore the flame temperature increases, so that the temperature of the reducing flame 15 in the flame is increased. Because of a synergistic effect due to this phenomenon and the enhanced ignitability, the consumption of oxygen at the central portion of the flame is promoted, so that the reducing flame 15 of a low oxygen concentration can be formed over a wide range from a position close to the burner to the downstream end portion of the flame. As a result, NOx produced at an initial stage of the combustion is reduced into nitrogen gas ($N_2$) in the reducing flame 15 by ammonia ($NH_3$) converted from nitrogen contained in the coal, so that the coal combustion efficiency, as well as the reduction of NOx, can be achieved.

Reference is now made to results of tests in which pulverized coal is burned in the burner of this embodiment.

In the test, pulverized coal is burned at a rate of 25 kg per hour, and the air ratio of the burner is varied by changing the amount of the combustion air supplied to the burner. Under such various conditions, the NOx discharge concentration as well as the coal combustion efficiency is measured. The fuel ratio of coal used for the test, represented by "fixed carbon content/volatile matter content" is 2.4, and its nitrogen content is 2 wt. %. With respect to the relation between a coal particle size distribution and a cumulative weight frequency, three groups of coal particles (one of which has a relation shown in FIG. 3 while the other two have relations shown in FIG. 4) are prepared. The relation shown in FIG. 3 corresponds to a group of coal particles usually used in a pulverized combustion burner. Coarse pulverized coal group which is represented by (□) in FIG. 4 contains particles with a particle size of not more than 75 μm (about 200 mesh) in an amount slightly larger than 50% of the total amount of the coal, and does not contain any particles with a particle size of more than 300 μm. Fine pulverized coal group which is represented by (Δ) in FIG. 4 contains particles with a particle size of not more than 20 μm in an amount slightly larger than 50% of the total amount of the coal, and contains particles with a particle size of not more than 53 μm (280 mesh) in an amount of about 80% of the total amount of the coal, and does not contain any particles with a particle size of more than 300 μm. Namely, the pulverized coal is divided into the coal particle group, having a large amount of coarse pulverized coal, and the coal particle group having a large amount of fine pulverized coal.

With respect to burner-operating conditions, the mixture flow in the outer passage of the pulverized coal nozzle, as well as the mixture flow in the inner passage of the pulverized coal nozzle is injected at 13 m/s. The stoichiometric ratio of each of the mixture flows flowing respectively through the two passages is about 0.2, and the secondary air is supplied in an amount corresponding to the stoichiometric ratio of 0.2. By changing the amount of the tertiary air to be supplied, the stoichiometric ratio is adjusted. The speed of injection of the tertiary air is in the range of 45 m/s and 53 m/s although it may vary depending on the amount of the tertiary air.

Figure 3:
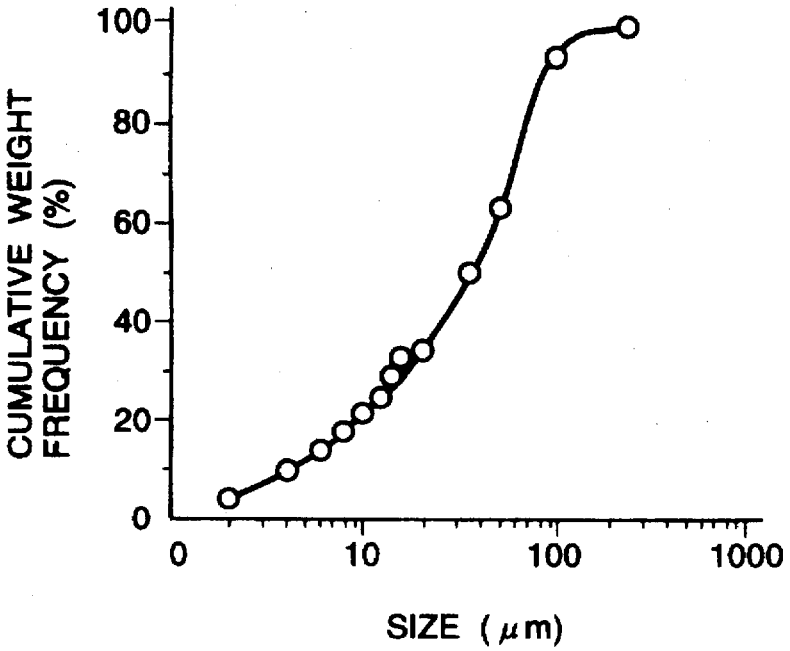
FIG. 3 is a graph showing a particle size distribution of ordinary coal particles used in a burner.
Figure 4:
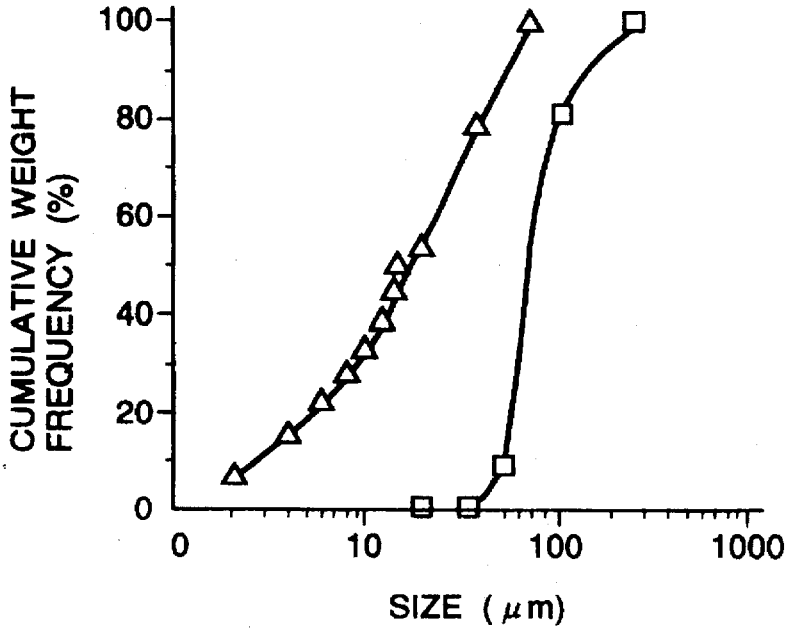
FIG. 4 is a graph showing two particle size distributions of coal particles used in the burner of the invention.

The test is carried out with respect to the following four cases. A first case is where coal particles, having a particle size distribution shown in FIG. 3, are fed into both of the outer and inner passages of the pulverized coal nozzle. The result is represented by (Δ). A second case is where coal particles (shown in FIG. 4) having a large amount of coarse pulverized coal are fed into the inner passage while coal particles (shown in FIG. 4) having a large amount of fine pulverized coal are fed into the outer passage. The result is represented by (□). A third case is where coal particles (shown in FIG. 4) having a larger amount of coarse pulverized coal are fed into the outer passage while coal particles (shown in FIG. 4) having a larger amount of fine pulverized coal are fed into the inner passage. The result is represented by (■). A fourth case is where coal particles, having a particle size distribution shown in FIG. 3, are fed to a burner having the same construction as that of the burner of FIG. 1 but having no separation wall. This case corresponds to a conventional burner. The result is represent by (○). The results of the test are shown in FIGS. 5–7.

Figure 5:
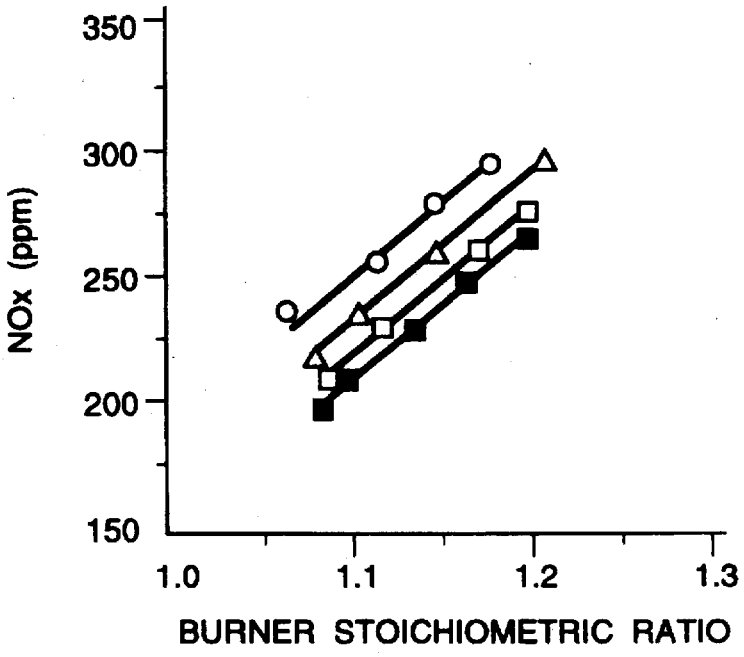
FIG. 5 is a graph showing the relation between the stoichiometric ratio of the burner and a NOx concentration.

It is clear from FIG. 5 that the NOx-reducing effect is achieved by the separation wall. When the passage for the coal particles are divided into the two passages, and two groups of coal particles different in particle size distribution are fed respectively into the two passages, the NOx-reducing effect is superior when the coal particles, having a large amount of fine pulverized coal, are fed into the outer passage.

Figure 6:
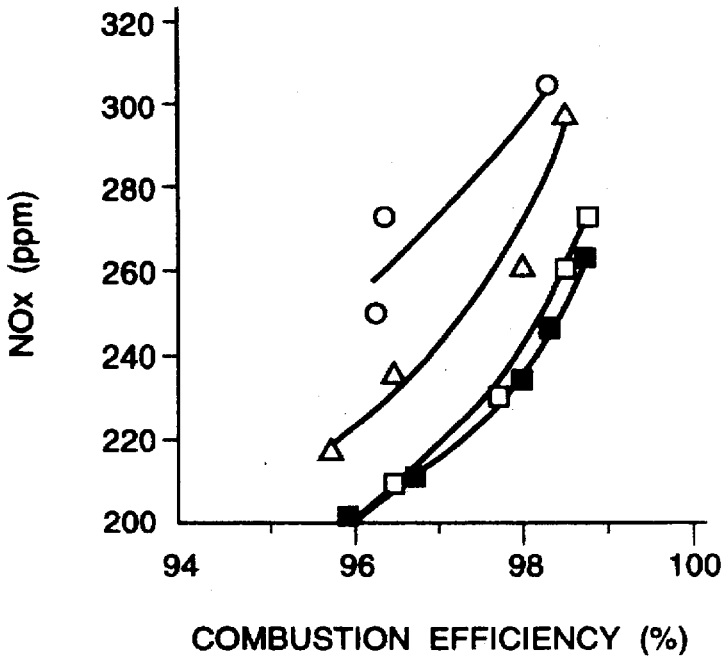
FIG. 6 is a graph showing a relation between the combustion efficiency and a NOx concentration.

FIG. 6 shows the relation between the NOx discharge concentration and the coal combustion efficiency. It clearly shows the effect of the separation wall, as well as the effect achieved when two groups of pulverized coal, having different particle sizes, are injected from the pulverized coal nozzle.

Figure 7:
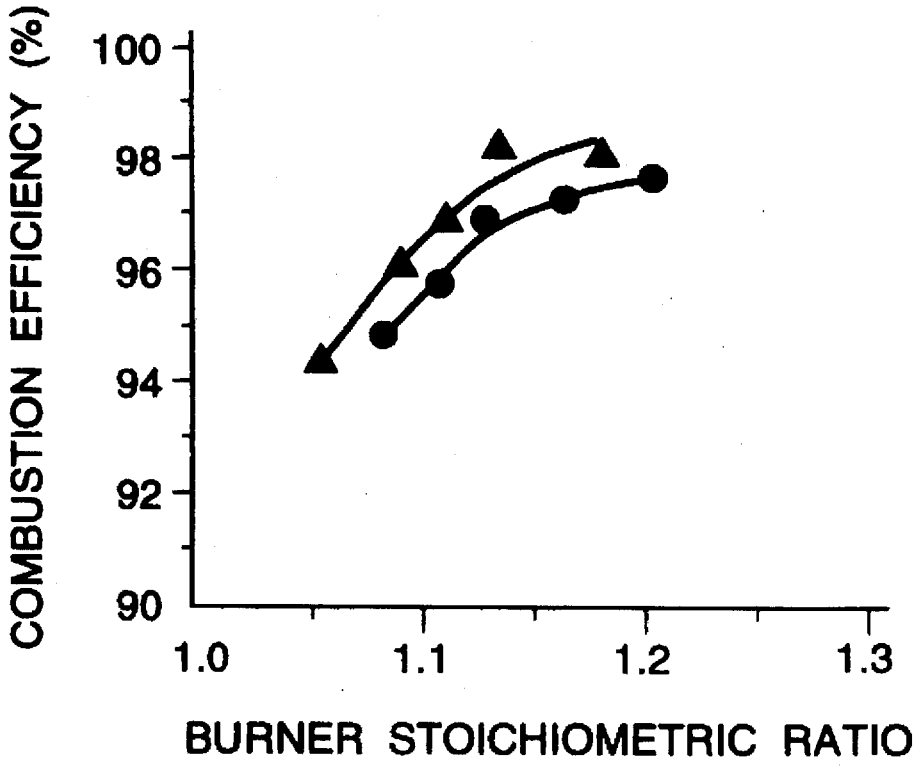
FIG. 7 is a graph showing a relation between the stoichiometric ratio and the combustion efficiency.

FIG. 7 shows results of tests for the combustion efficiency, obtained when the separation wall is not provided (●), and when the separation wall is provided and two groups of coal particles having the same particle size distribution are fed into the two passages, respectively (▲). The effect achieved by the separation wall is clear.

Figure 8:
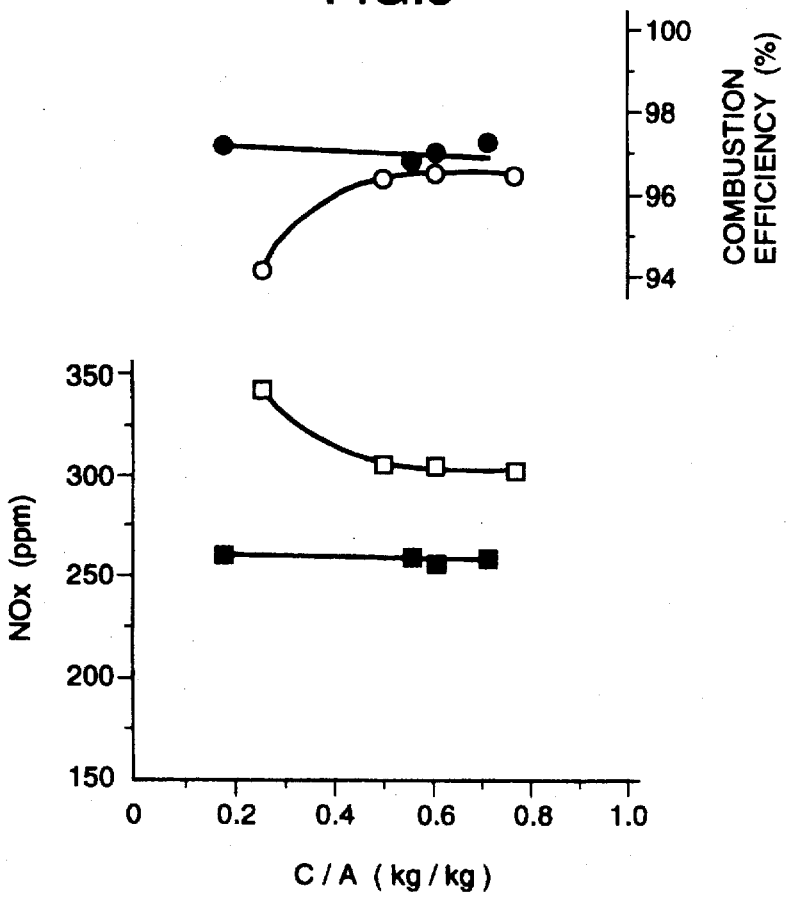
FIG. 8 is a graph showing the relation between the ratio (C/A) and the NOx concentration, as well as the relation between the ratio (C/A) and the combustion efficiency.

FIG. 8 shows influences on the NOx discharge amount and the coal combustion rate when the rate (C/A) of the coal feed rate (C) to the air flow rate (A) (which transfers the coal) is changed. In the conventional burner having no separation wall, when the ratio (C/A) becomes less than 0.4, the ignitability of coal as well as the flame stability is lowered, so that the combustion efficiency (○) decreases, and the NOx discharge concentration (□) increases. An acceptable minimum load of the burner is 40%. To the contrary, in case two groups of coal particles, having the same particle size distribution, are fed respectively to the two passages of the pulverized coal nozzle of the burner having the separation wall, until the ratio (C/A) is kept above about 0.15, the burner, having the separation wall, exhibits a high combustion efficiency (●), and also exhibits a low NOx discharge concentration (■).

Figure 9:
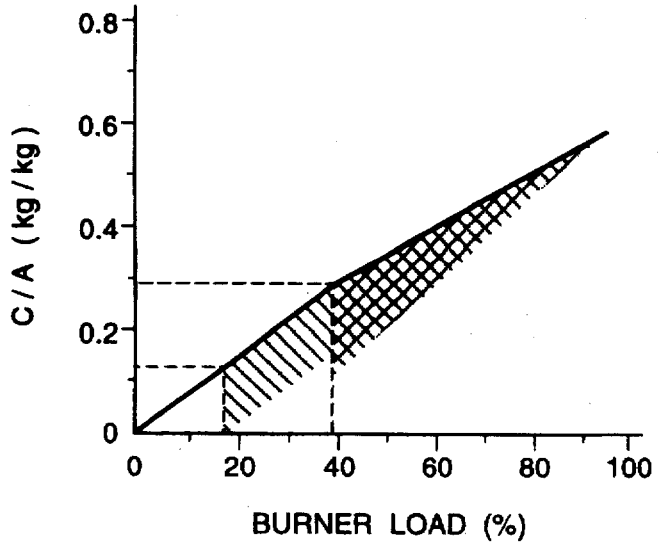
FIG. 9 is a graph showing the relation between the burner load and the ratio (C/A)

FIG. 9 shows the relation between the load of the burner and the ratio (C/A). The minimum load of the burner of the present invention is 15%, and the range (hatched portion) of operation of this burner is very much larger than that (meshed portion) of the conventional burner whose minimum load is 40%.

In this embodiment, the secondary air nozzle and the tertiary air nozzle are separated from each other by the spacer 3. Namely, the secondary air flow and the tertiary air flow are spaced slightly from each other. With this arrangement, the oxidizing flame region and the reducing flame region are clearly distinguished or separated from each other, so that the above-mentioned effects can be achieved. However, even if the spacer 3 is removed to unify the secondary and tertiary air nozzles, an oxidizing flame region and a reducing flame region, though not clearly separated from each other, can be formed in a similar manner as described above, thereby reducing the NOx amount.

Figure 10:
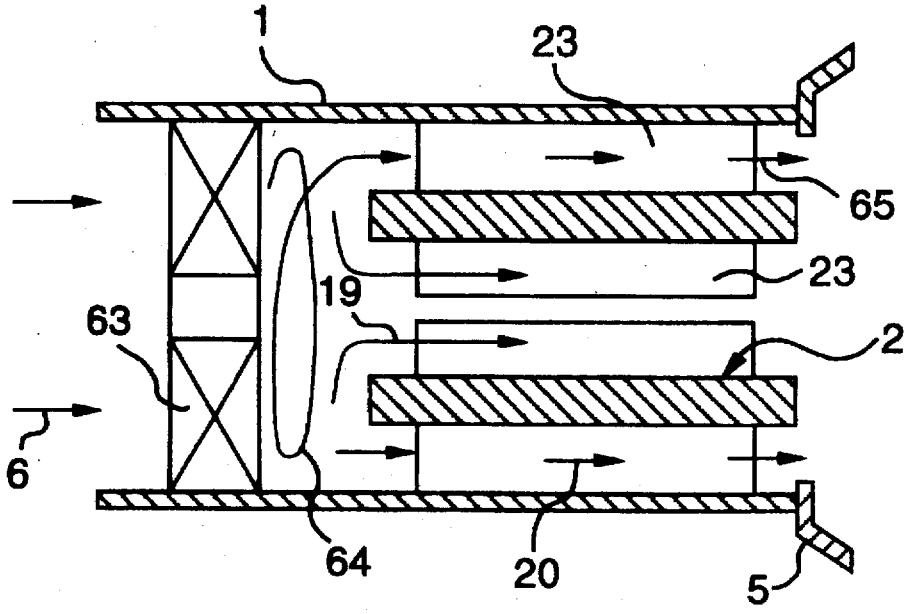
FIG. 10 is a cross-sectional view of a pulverized coal combustion burner according to another embodiment of the invention.
Figure 11:
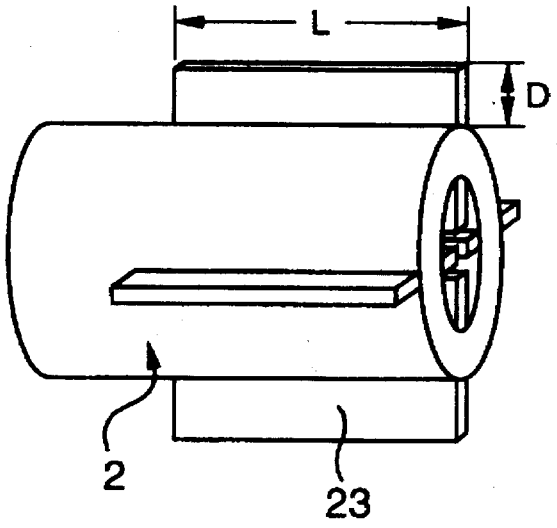
FIG. 11 is a perspective view of a separation wall in the burner of FIG. 10.

Another preferred embodiment of the invention, in which a swirl device and a separation wall are provided within a pulverized coal nozzle, will now be described with reference to FIGS. 10 and 11. FIG. 10 shows only the structure of a pulverized coal nozzle portion, and does not show a whole of the burner. In this embodiment, the throat 18 is not provided.

The swirl device 63 is provided at an upstream side (that is, at an inlet portion) of the pulverized coal nozzle 1, and the annular separation wall 2 is provided in parallel relation to an inner peripheral surface of the nozzle 1. Four plate-like members 23 are mounted on an outer and an inner peripheral surfaces of the annular separation wall 2, respectively. The length (L) of the plate-like member 23 is five times larger than the height (D) thereof. The coal particles flow straight along the annular separation wall 2 because of the plate-like members 23 provided on the separation wall 2.

The operation and effects of this embodiment will now be described hereinafter.

A straight flow of a mixture 6 of pulverized coal and primary air, introduced into the pulverized coal nozzle 1, is formed into a swirl 64 by the swirl device 63. The swirl 64 is divided into an inner mixture flow 19 flowing through the inside of the separation wall 2, and an outer mixture flow 20 flowing through an outer passage. The coal particles having a large particle size are mainly introduced into the outer passage whereas coal particles of a small particle size, liable to be entrained in a stream, flow into the inner passage by means of a centrifugal force due to swirl. If the mixture flow in the outer passage is injected as a swirl flow, the coal particles would have an outward velocity component to be dispersed outwardly immediately after they are injected from the outer passage. To prevent this, the plate-like members 23 are provided to stop the swirl of the mixture flow. The mixture flow, formed into the swirl flow 64 by the swirl device 63, impinges on the plurality of the plate-like members 23 to lose a swirling force, and then is injected as a straight flow from the nozzle. As a result, recirculation flows are generated downstream of a flame stabilizing ring 5 and the annular separation wall 2.

The plate-like members 23 also serve as cooling fins. In the present invention, the recirculation flows are generated in proximity to the separation wall 2, and the coal particles are ignited at the position. Therefore there is a fear that the temperature of the separation wall rises due to radiation and convection heat transfer from the flame, so that the separation wall may be burned and damaged. When the plate-like members are provided on the separation wall, there is achieved an advantageous effect that the flow of the mixture of the coal particles (usually of not more than 80° C.) fed from a pulverizer and the primary air comes into contact with the plate-like members, thereby cooling the separation wall 2. Moreover, the temperature of the flow of the mixture of the coal particles and the primary air rises through heat exchange with the plate-like members, thus achieving a synergistic effect that the ignitability of the coal particles injected from the nozzle is further enhanced.

It is preferable to provide a swirl device with a plurality of openings circumferentially spaced from each other, through which the mixture of the coal particles and the primary air flows. Further, it is preferable that the mixture is supplied into the swirl device through a plurality of portions thereof. In this connection, FIGS. 12 and 13 should be referred to. According this, it becomes possible to disperse the mixture uniformly in a circumferential direction, thereby preventing the concentration of the pulverized coal from being uneven in circumferentially and enhancing a flame stability. In case the mixture is introduced into the swirl device through a only one portion thereof, the concentration of the pulverized coal is locally increased. As a result, the flame becomes unstable. The more the number of the openings of the swirl device is, the less the unevenness of the concentration of the pulverized coal in a circumferential direction is.

In case there is provided with the swirl device in the pulverized coal nozzle, due to a centrifugal force caused by the swirl of the mixture, the pulverized coal is classified or divided into two groups, namely the coarse pulverized coal and the fine pulverized coal. The coarse pulverized coal concentrates on a peripheral portion of the pulverized coal passage while the fine pulverized coal concentrates on a central portion thereof, which is readily entrained by the mixture flow. In order to enhance such classification, it is preferable to provide a classification space downstream side of the swirl device.

In such classification space, the larger the pulverized coal particle is, the stronger the centrifugal force applied to the particle becomes. Therefore the coarse pulverized coal of a relative large particle size, which flows a central portion of the pulverized coal nozzle upstream side of the swirl device, concentrates to a radial outer peripheral portion of the pulverized coal nozzle. As a result, the pulverized coal flowing along the central portion of the nozzle includes the particles of relatively small size. The possibility that the pulverized coal is supplied to a reducing flame area at a central portion of the flame is enhanced by supplying the pulverized coal into the furnace from a central portion of the pulverized coal nozzle. Since the fine pulverized coal has a specific ratio of surface area to weight higher than that of the coarse pulverized coal, the fine pulverized coal has a higher reactivity. Therefore, when such fine pulverized coal can be concentrated into a central portion of the pulverized coal nozzle, it can be possible to activate a thermal decomposition reaction of the coal with carbon dioxide or water in the reducing flame area. According this, the NOx precursor (for example, $NH_3$ and HCN) generated from the coal particles in the reducing flame area is increased in the amount thereof, and then an ability for reducing NOx generated in the oxidizing flame area is enhanced. Therefore, it becomes possible to reduce a concentration of NOx generated in combustion of the pulverized coal burner.

The preferable manner of provision of the swirl device is as follows. An intervenient member is disposed in the pulverized coal passage so as to reduce a cross sectional passage area thereof. The intervenient member is so shaped that such passage area is once decreased and then increased along the flow of the mixture. The vanes of the swirl device for swirling the mixture are to be located a portion of the pulverized coal passage an area of which is smallest.

This causes the following three phenomena.

A first one is that the pulverized coal passage is reduced by the intervenient member. Due to the inertia force caused by the pulverized coal particles moving radial outwards, such particles are directed radial outwards from the carrying air. The pulverized coal concentrates to a portion adjacent the outer periphery of the pulverized coal passage, thereby enhancing a concentration of the pulverized coal at such portion.

A second one is that the intervenient member is disposed at the pulverized coal passage portion in which the passage area is smallest. The higher the swirl generation efficiency becomes, the longer the circumferential space between the adjacent vanes is. Therefore, a strong swirl can be generated without increasing a pressure loss of the swirl device.

A third one is that the pulverized coal passage is reduced at a sectional area thereof upstream side of the intervenient member. Accordingly, the carrying air concentrates to a central portion of the pulverized coal passage and then fine pulverized coal of less inertia also concentrates to a central portion of the passage with following the carrying air. However, the coarse pulverized coal of larger inertia flows without following the carrying air, and then an amount of pulverized coal flowing the outer periphery of the pulverized coal passage is increased.

These phenomena causes the pulverized coal to concentrate to the outer periphery of the pulverized coal passage, thereby enhancing the ignitability and the flame holding ability.

The coarse pulverized coal, which concentrates to the outer periphery of the pulverized coal passage due to the swirl device and the classification space following the swirl device, is mixed with the fine pulverized coal flowing at the central portion of the pulverized coal passage, and then supplied into the furnace through the opening edge of the pulverized coal nozzle. The actual concentration of the pulverized coal supplied through the opening edge of the nozzle is higher than the concentration determined or calculated on the basis of the amounts of the coal and the combustion air supplied. Namely, the local concentration becomes higher than the mean concentration. Therefore, the flame can be maintained stable by means of the pulverized coal supplied from the opening edge of the nozzle. According this, it is possible to increase an amount of coal particles which are to be burnt at an area adjacent the pulverized coal nozzle, thereby raising the flame temperature. The high flame temperature raises the reducing flame area and then the thermal decomposition ability of the coal in the oxidizing flame area is enhanced accordingly. As a result, the NOx reduction reaction in the reducing flame area is promoted, thereby reducing the concentration of NOx generated in the coal combustion of the pulverized coal burner.

The plate-like member disposed downstream side of the separation wall can improve the separation ability of the pulverized coal. The plate-like member stops the swirl flow and eliminates a swirl component from the swirl flow so as to convert the swirl flow into a straight flow. At the moment, the mixture flow is disturbed and then the coal particles concentrated in the outer periphery of the pulverized coal passage are dispersed.

The speed of the mixture injected from the outlet of the separation wall can be changed by varying a cross-sectional shape of the tubular separation wall. For example, in case that the tubular separation wall with gradually increasing cross section along a longitudinal direction thereof is employed, if such separation wall is so disposed in the pulverized coal nozzle that an axial end of the separation wall of a small cross-section is located upstream with respect to the mixture flow, the flow of the mixture between the pulverized coal nozzle and the separation wall is decelerated while the flow of the mixture within the separation wall is accelerated. Accordingly, an injection speed of the mixture at the pulverized coal nozzle becomes uniform in a radial direction. In case a difference in the speed between two concentric flows is small, these flows are hardly mixed with each other. Therefore, a coal particle distribution pattern in a radial direction at the nozzle outlet is held at a portion axially apart from the nozzle outlet. According this, the pulverized coal of fine particles can be mainly supplied to the reducing flame area, thereby promoting the NOx reducing reaction in the reducing flame area. As a result, an amount of NOx is reduced.

A burner above explained will be described hereinafter, in which a swirl device, a separation wall, and a plate-like member for converting a swirl flow into a straight flow are disposed within a pulverized coal nozzle.

Figure 12:
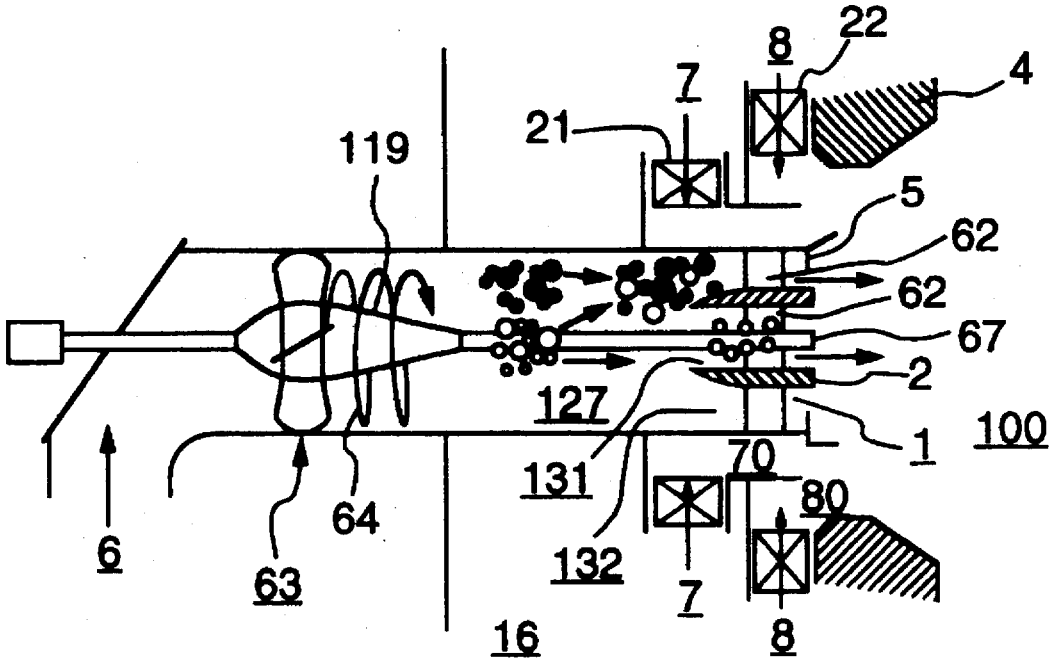
FIG. 12 is a cross-sectional view showing a pulverized coal burner according to another embodiment of the present invention.
Figure 13:
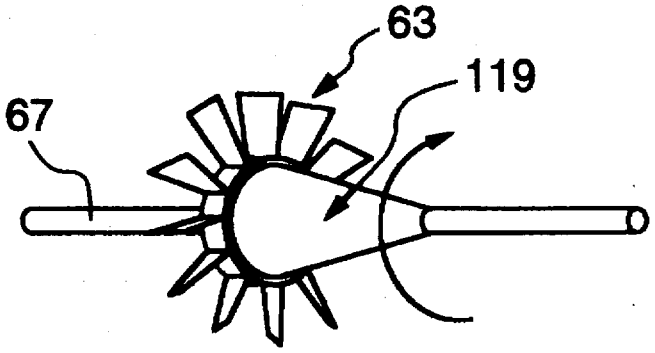
FIG. 13 is a perspective view of the swirl device shown in FIG. 12.

The burner shown in FIG. 12 includes an intervenient member 119 for reducing a passage of the mixture 6, which is disposed a radial central portion of the pulverized coal nozzle 1. A swirl device 63 provided with a plurality of sectorial vanes is mounted on an outer periphery of the intervenient member 119. A separation wall 2 is disposed at axial downstream end portion of the nozzle 1 so as to provide therebetween a space 127. The space 127 is an annular tubular passage defined between an oil gun 67 and the nozzle 1. The intervenient member 119 has a first portion which cooperates with the nozzle 1 to provide a gradually decreasing passage section of the pulverized coal passage along the mixture flow, and a second portion connected to the first portion, which cooperates with the nozzle 1 to provide a constant passage section of the pulverized coal passage, and a third portion connected to the second portion, which cooperates with the nozzle 1 to provide a gradually increasing passage section of the pulverized coal passage along the mixture flow.

The swirl devices 21 and 22 are adjustable in angle of vane by control rods as described in connection with the swirl device shown in FIG. 1. However, in FIG. 12, such control rods are omitted.

The swirl device 63 includes a plurality of vanes extending radially and circumferentially spaced from each other. The mixture of the pulverized coal and the primary air flows between adjacent two vanes to generate a swirl flow 64. FIG. 12 shows how the pulverized coal (●) flowing along the periphery of the pulverized coal nozzle 1 and the pulverized coal (○) flowing along a central portion of the pulverized coal nozzle 1 are concentrated or separated in the space 127 by means of the swirl force.

The pulverized coal passage is divided at outlet portion thereof into a cylindrical inner passage portion 131 and an annular outer passage portion 132 by the annular separation wall 2. By means of the swirl device 63 and the intervenient member 119, a large amount of coarse pulverized coal concentrates along the periphery of the pulverized coal nozzle 1 while a larger amount of fine pulverized coal concentrates along the central portion of the pulverized coal nozzle 1. They are divided into two flows by the separation wall 2, and converted from the swirl flow into the straight flow to be injected into the furnace 100.

Figure 14:
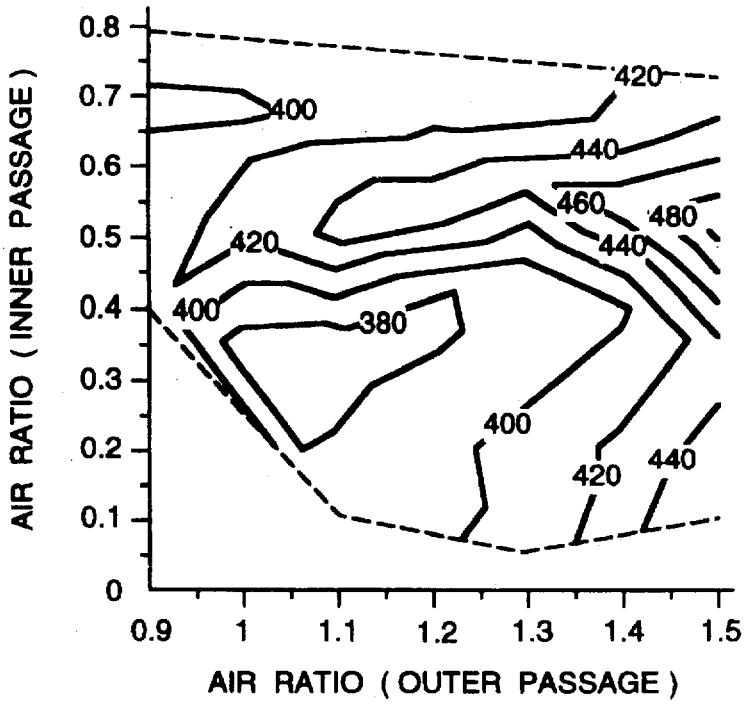
FIGS. 14 and 15 are graphs showing NOx concentration.
Figure 15:
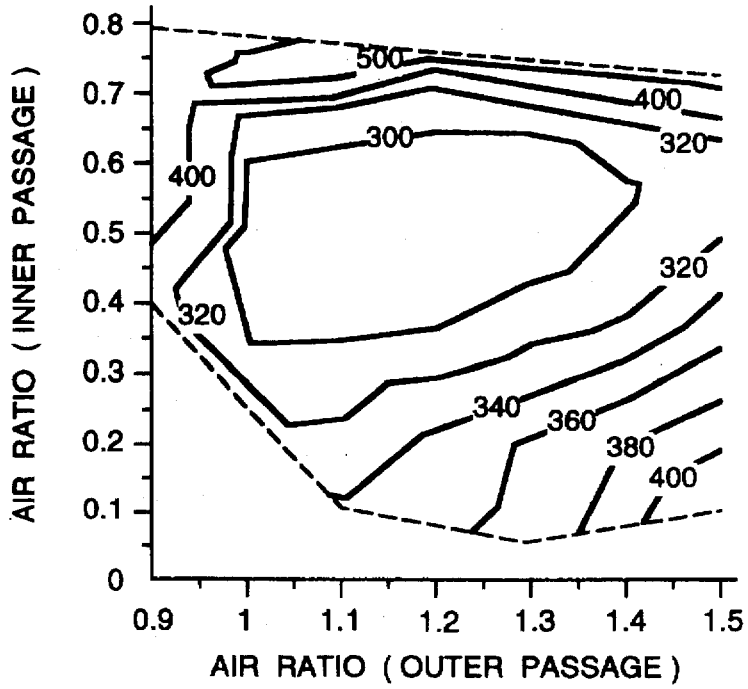

The concentration of NOx generated in coal combustion in the burner shown in FIG. 12 will be described hereinafter with reference to FIG. 14. In the burner, the fine pulverized coal is injected through the inner passage portion 131 and the coarse pulverized coal is injected through the annular outer passage portion 132. FIG. 14 shows a change of NOx concentration (ppm) detected under the condition that the air ratios in the inner passage portion 131 and the outer passage portion 132 are varied respectively. The "air ratio" means a ratio of the flow rate of primary air flowing through the passage portion to the flow rate of air required to burn out the pulverized coal completely. The fine pulverized coal includes pulverized coal whose particle size is less than 53 μm and the coarse pulverized coal includes pulverized coal whose particle size is less than 100 μm. FIG. 15 also shows a change of NOx concentration detected under the condition that the air ratios in the inner passage portion 131 and the outer passage portion 132 are varied respectively. However, in this case, the pulverized coal whose particle size is less than 100 μm flows through not only the passage portion 132 but also the passage portions 131. The comparison of the disclosures in FIGS. 14 and 15 shows that the NOx concentration can be reduced about 20% and a range of the air ratios under which a low NOx combustion can be obtained is widened by means of making the fine pulverized coal flow through the inner passage portion 131. The reason is that the fine pulverized coal from the inner passage portion 131 is mainly supplied to the reducing flame area. As compared with the coarse pulverized coal, the fine pulverized coal has a promoted activity and includes a larger amount of solid components to be thermally decomposed by carbon dioxide and water even in the reducing flame area in which oxygen has been consumed. Therefore, it can be possible to relax the restraint of formation of the reducing flame atmosphere formed by the gas from the oxidizing flame area, thereby promoting the NOx reduction reaction in the reducing flame area.

Figure 16:
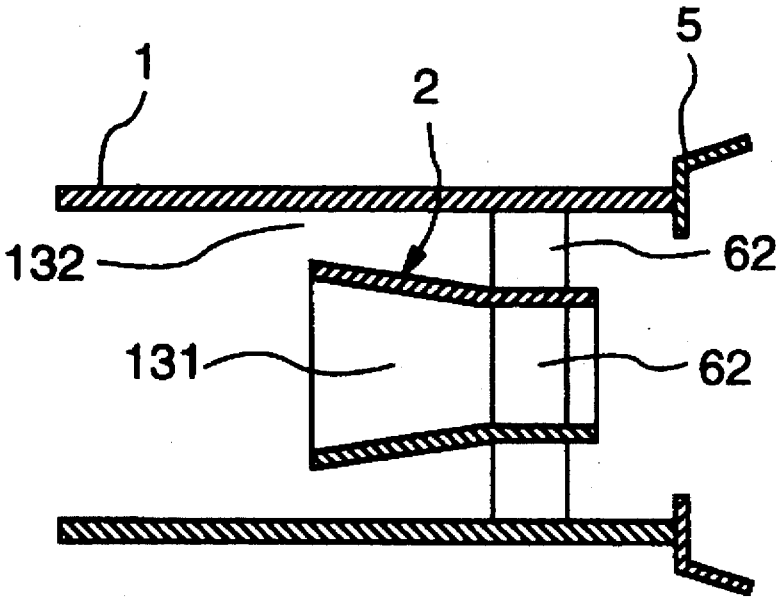
FIG. 16 is a cross-sectional view showing a pulverized coal burner according to still another embodiment of the present invention.

FIG. 16 shows a burner according to still another embodiment. Since the secondary air nozzle and the tertiary air nozzle is the same as those in FIGS. 1 and 12, they are omitted from the drawings.

The burner shown in FIG. 16 includes a tubular separation wall 2 having a first portion whose outer diameter is gradually decreasing along the mixture flow, and a second portion connected to the first portion, whose outer diameter is constant. The separation wall 2 decelerate the mixture flowing through outer tubular passage portion defined by the pulverized coal nozzle 1 and the separation wall 2 while accelerate the mixture flowing through the inner passage portion within the separation wall 2. According this, the mixture injected from the outlet of the pulverized coal nozzle 1 has a substantially uniform velocity in a radial direction. Namely, a difference in injection velocity between the two mixture flows flowing through the outer passage portion and the inner passage portion becomes small. Accordingly, they are prevented from being mixed with each other and then the fine pulverized coal from the inner passage portion can be effectively supplied into the reducing flame area. Since the fine pulverized coal has a higher ratio of surface area to weight, the fine pulverized coal can be readily reacted with carbon dioxide or water even in the reducing flame area. According this, the NOx precursor are generated to reduce a concentration of NOx more efficiently.

Figure 17:
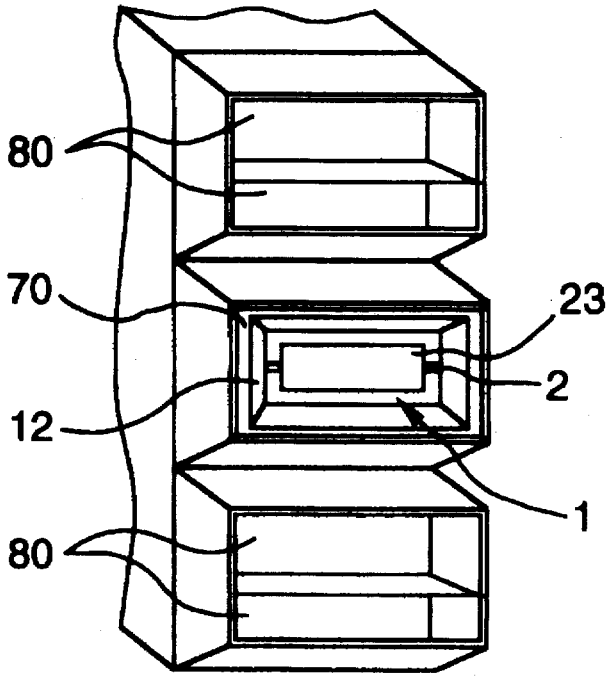
FIG. 17 is a perspective view of a pulverized coal combustion burner according to a further embodiment of the invention.
Figure 18:
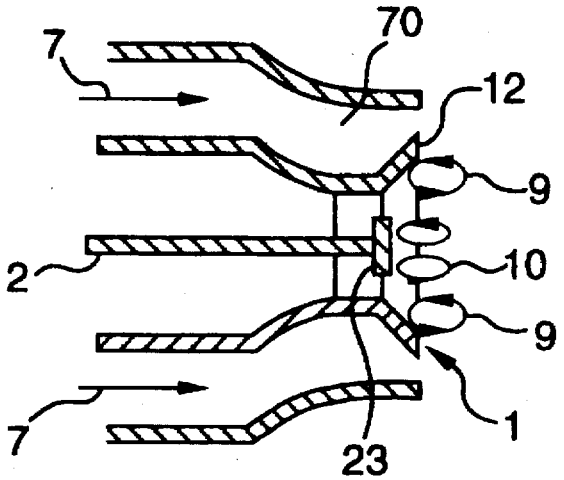
FIG. 18 is a cross-sectional view of a portion of the burner of FIG. 17.
Figure 19:
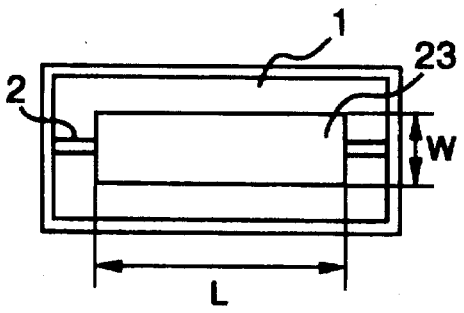
FIG. 19 is a front-elevational view showing an injection port of a pulverized coal nozzle of FIG. 17.

A further embodiment of a pulverized coal combustion burner of the invention will now be described with reference to FIGS. 17 to 19.

In the burner of this embodiment, an outlet of a pulverized coal nozzle 1 has a rectangular shape, and a secondary air nozzle 70 surrounds the outlet. Tertiary air nozzles 80 are provided on opposite sides of the secondary air nozzle 70 in slightly spaced relation thereto. In this embodiment, the bore of the pulverized coal nozzle 1 is narrowed or constricted at a portion thereof adjacent to the outlet, and is expanded outwardly at the outlet. Therefore, recirculation flows 9 are formed downstream of this expanded tube portion 12. The interior of the pulverized coal nozzle 1 is divided into two passages by a separation wall 2, and a flame stabilizer 23 in the form of a rectangular plate is mounted on an outer end of the separation wall 2 so as to form recirculation flows 10. Preferably, a length (L) of the flame stabilizer 23 is not less than 6 times larger than a width (W) thereof (see FIG. 19), and the width (W) is preferably not less than 10 mm.

A pulverized coal combustion apparatus using burners of the present invention will now be described.

Figure 20:
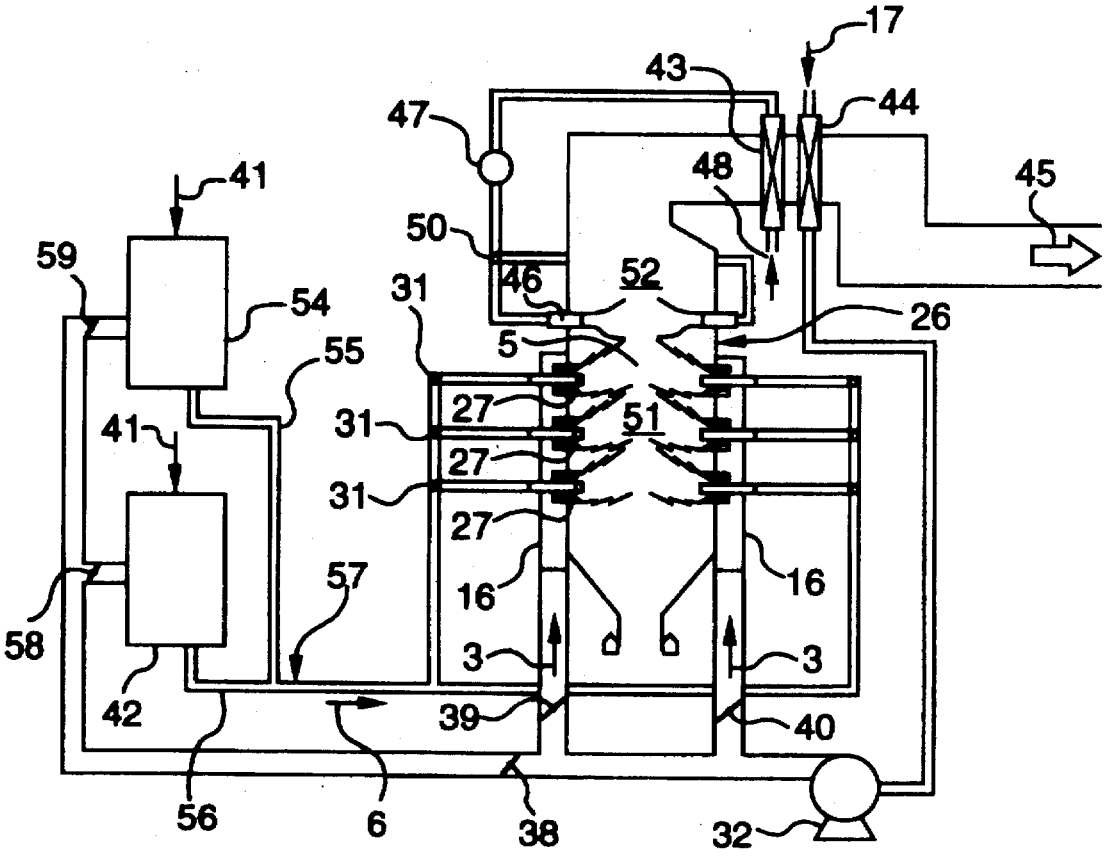
FIG. 20 is a schematic view showing the construction of a pulverized coal combustion apparatus employing the burner of the present invention.

FIG. 20 shows a front facing-type boiler having a burner arrangement utilizing a two-stage combustion method. Two-stage combustion air nozzles 46 for forming a secondary combustion region 52 are provided above the burner stages. Pulverized coal burners 27 each having the same construction as shown in FIG. 1 are arranged in three stages in a longitudinal direction of a furnace 26, and are also arranged in five rows in a transverse direction of the furnace 26 although this transverse arrangement is not shown in the drawings. The number and arrangement of the burners are determined depending on the capacity of the burner (the maximum coal combustion rate) and the capacity and construction of the boiler.

The pulverized coal burners 27 are mounted in a wind box 16. The coal particles are transferred from pulverizers 42 and 54 to the burners 27 through respective distributors 31. The air 17 for the combustion of coal is heated to about 300° C. by a heat exchanger 44 provided in a flue connected to an outlet of the furnace. The heated air is fed to the wind box 16 by a blower 32, and then is injected as secondary and tertiary airs into the furnace 26. The flow rate of the air 33 to be introduced into the wind box 16 is adjusted by dampers 39 and 40. The air 48 for two-stage combustion is heated by a heat exchanger 43 to about 300° C. as described for the combustion air. The heated air is fed to an exhauster 47 and then to a distributor 50 where the flow rate of the air 48 is adjusted, and then the air 48 is fed to the two-stage combustion air nozzles 46.

NOx and SOx are removed from the flue gas 45 discharged from the furnace 26 by an exhaust gas treatment device (not shown) so as to give no adverse effects on the environment. Thereafter, the flue gas 45 is discharged to the exterior of the system.

The combustion air in an amount corresponding to 80%–90% of the theoretical amount of the air is injected from each pulverized coal burner 27, and the remainder is injected from the two-stage combustion air nozzle 46. Preferably, the air in an amount corresponding to about 40%–30% of the theoretical amount of the air for coal is injected from the two-stage combustion nozzle 46 so that an excess air factor (ratio) with respect to the total air amount can be about 20%.

Although this combustion apparatus is provided with the two pulverizers, the apparatus may have only one pulverizer if coal particles having the same particle size distribution are fed to the two passages in the pulverized coal nozzle. Alternatively, one of the two pulverizers may be used. When two groups of coal particles having different particle size distributions are to be fed respectively to the two passages of the pulverized coal nozzle, it is desirable that fine pulverized coal be produced by one of the two pulverizers whereas coarse pulverized coal is produced by the other pulverizer. Description will now be made with respect to the case where the pulverizer 42 serves as a fine pulverizer whereas the pulverizer 54 serves as a coarse pulverizer.

Figure 21:
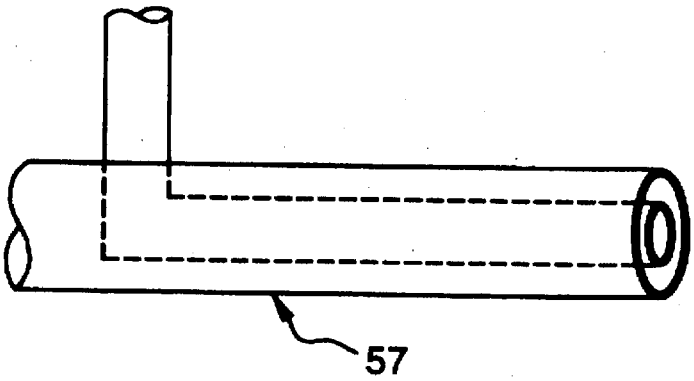
FIG. 21 is a perspective view showing a coal feed pipe in the apparatus of FIG. 20.

The air-for transferring the coal is adjusted in flow rate by dampers 38, 58 and 59 and is fed to the pulverizers 42 and 54. The coal 41 is also fed to the pulverizers 42 and 54. The air is heated by the heat exchanger 44, and serves as primary air for the combustion of the coal. The coal 41 is pulverized by the pulverizers 42 and 54 into fine particles at least on the order of not more than 300 μm and preferably several tens of μm. Feed pipes 55 and 56 are connected respectively to the pulverizers 54 and 42, and then are connected to a feed pipe 57 in the form of a double pipe. The construction of the feed pipe 57 is shown in FIG. 21. A mixture of fine pulverized coal and the air flows through an outer passage of the double pipe 57 while a mixture of coarse pulverized coal and the air flows through an inner passage of the double pipe 57. The feed pipe 57 constituted by this double pipe is connected to each burner received in the wind box 16, and the fine pulverized coal and the coarse pulverized coal are supplied to the pulverized coal nozzle independently.

If the feed pipes 55 and 56 for respectively feeding the coarse pulverized coal and the fine pulverized coal are extended separately to the burners, the space or area of installation of these pipes becomes large, and besides the piping system becomes complicated. This is not desirable from an economical point of view. However, if these feed pipes are constituted by the double pipe as in this embodiment, the above problem can be overcome. When it is necessary to change the combustion rate of the pulverized coal combustion apparatus so as to vary the combustion load, the pulverization rates of the two pulverizers are adjusted, or one of the two pulverizers is stopped while operating the other pulverizer, thereby adjusting the pulverization rate. By adopting such operation method, the turndown of the pulverized coal combustion apparatus can be effected easily, so that the combustion of the pulverized coal can advantageously be carried out over a wide load range.

In this pulverized coal combustion apparatus, two flows of coal particles are injected from the pulverized coal combustion burner, and two recirculation flows are formed. Therefore, the ignitability of the coal as well as the flame stability is excellent, and then the combustion efficiency at a primary combustion region 51 is increased. As a result, the unburned content as well as NOx discharged from the primary combustion region 51 is reduced, and then the longitudinal length of the furnace can be reduced, so that the furnace 26 can advantageously be of a compact design.

The burner of the present invention can be applied not only to the above-mentioned combustion apparatus of the two-stage combustion type but also to the type of combustion apparatus in which the combustion is completed only by combustion flames of burners. In the latter case, combustion air is supplied in an amount corresponding to about 120% of the theoretical amount of the air for coal. Even when such a single-stage combustion method is used, the ignitability and the flame stability are enhanced because of the use of the burners of the present invention as compared with a conventional combustion apparatus, and therefore there is achieved an advantageous effect that the furnace can be of a compact design. Moreover, as a result of enhancement of the coal ignitability and the flame stability, there is achieved an advantageous effect that the combustion can be effected only by coal in so far as the load is kept above about 15%.

Figure 22:
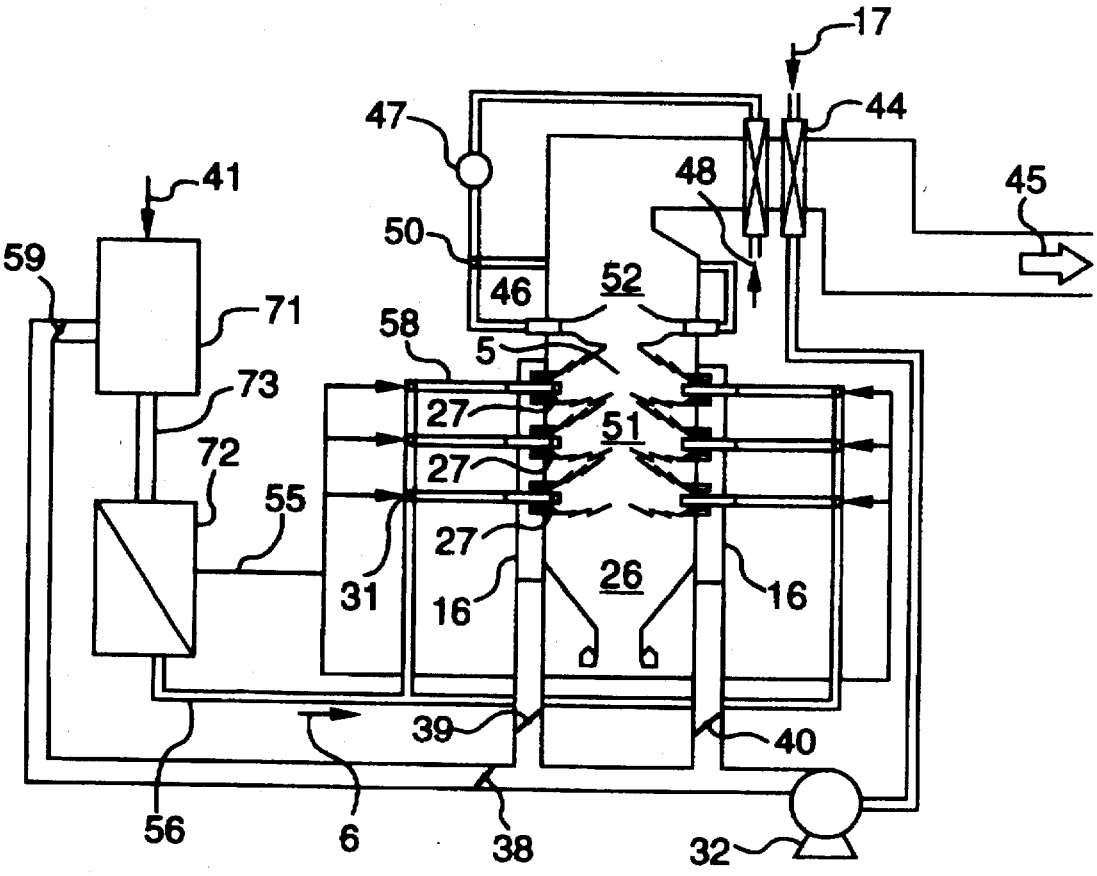
FIG. 22 is a view showing the construction of a modified pulverized coal combustion apparatus.

A pulverized coal combustion apparatus of the invention which employs a pulverizer 71 and a classifier 72 instead of the fine pulverizer 42 and the coarse pulverizer 54 will now be described, with reference to FIG. 22.

The air for transferring coal is adjusted in flow rate by dampers 38 and 59, and is supplied to the pulverizer 71. This air is heated by a heat exchanger 44, and serves as primary air for the combustion of the coal. Lump coal 41 is pulverized by the pulverizer 71 into fine particles of not more than 300 μm.

The pulverized coal from the pulverizer 71 is fed to the classifier 72 through a feed pipe 73. The classifier 72 divides the pulverized coal into fine pulverized coal and coarse pulverized coal having particle size distributions shown in FIG. 4. The feed pipes 55 and 56 are connected to outlets of the classifier 72, respectively and then are connected to feed pipes 58 in the form of double pipe. A flow of a mixture of the fine pulverized coal and the air is fed to an outer passage of the feed pipe 58 while a flow of a mixture of the coarse pulverized coal and the air is fed to an inner passage of the feed pipe 58. The feed pipe 58 constituted by this double pipe is connected to each burner received in the wind box 16, and the fine pulverized coal and the coarse pulverized coal are supplied to a pulverized coal nozzle independently of each other.

In this combustion apparatus, similar effects as described above for the combustion apparatus of the preceding embodiment can also be achieved.

What is claimed is:

1. A pulverized coal combustion burner comprising:

a pulverized coal passage through which a mixture containing pulverized coal and air flows;

an air passage for supplying additional air to a flow of said mixture from outside;

a wall separating said pulverized coal passage from said air passage;

first recirculation flow-forming means provided at a downstream end of said wall for forming recirculation flows of said mixture and said additional air;

means for swirling the mixture flowing in said pulverized coal passage, said swirling means having a plurality of openings through which said mixture is supplied and said openings being disposed in a direction of the swirl, and means for converting said swirling mixture into a straight flow.

2. A burner according to claim 1, in which said pulverized coal passage has a circular transverse cross-section, and said separation wall has an annular transverse cross-section, wherein said coal/air mixture containing a relatively large amount of coarse pulverized coal is the radially inwardly-disposed straight flow, while the other straight flow of the coal/air mixture containing a relatively large amount of fine pulverized coal is the radially outwardly-disposed straight flow.

3. A burner according to claim 1, further comprising a separation wall for dividing said mixture flow into two straight flows.

4. A burner according to claim 3, wherein said pulverized coal passage has a circular transverse cross-section and said separation wall has an annular transverse cross-section, and said converting means has plate-like members extending radially between said wall separating said pulverized coal passage from said air passage and said separation wall.

5. A burner according to claim 4, wherein said plate-like members extend radially inward from said wall separating said pulverized coal passage and said air passage.

6. A burner according to claim 4, in which said plate-like members extend radially outward from said separation wall.

7. A burner according to claim 4, wherein a dimension of each plate-like member and a direction of flow of said mixture is not less than 5 times larger than a dimension of said plate-like member in a radial direction.

8. A burner according to claim 3, in which said separation wall has an outer peripheral surface, a diameter of which is gradually increasing and then becomes constant along the flow of said mixture.

9. A burner according to claim 3, further comprising an intervenient member disposed in said pulverized coal passage, said intervenient member cooperating with said pulverized coal passage to define therebetween a first passage portion, an area of which is gradually increasing, a second passage portion, an area of which is constant, and a third passage portion, an area of which is gradually increasing, said passage portions being arranged in order along the flow of said mixture and in which said swirling means is located in said second passage portion.

10. A burner according to claim 3, further comprising second recirculation flow-forming means provided at a downstream end of said separation wall for forming recirculation flows of said mixture and said additional air, said second recirculation flow-forming means being constituted by an end surface of said separation wall extending perpendicular to said straight flows.

11. A burner according to claim 10, wherein the thickness of the end surface of said separation wall in a direction perpendicular to said straight flows is not less than 10 mm.

12. A burner according to claim 11, wherein a radial inner edge portion of the end surface of said separation wall is recessed.

13. A burner according to claim 3, wherein said pulverized coal passage has a circular transverse cross-section and said separation wall has an annular transverse cross-section.

14. A burner according to claim 3, wherein said pulverized coal passage has a rectangular transverse cross-section and said separation wall has a flat plate-like configuration.

15. A burner according to claim 1, further comprising an intervenient member disposed in said pulverized coal passage, said intervenient member cooperating with said pulverized coal passage to define therebetween a first passage portion, an area of which is gradually decreasing, a second passage portion, an area of which is constant, and a third passage portion, an area of which is gradually increasing, said passage portions being arranged in order along the flow of said mixture and in which said swirl means is located in said second passage portion.

16. A burner according to claim 1, further comprising a coal pulverizer for pulverizing coal into fine particles having a particle size of not more than 300 μm, said coal pulverizer being in communication with said pulverized coal passage.

17. A burner according to claim 1, wherein said air passage comprises a secondary air passage concentrically surrounding said pulverized coal passage and a tertiary air passage concentrically surrounding said secondary air passage.

18. A burner according to claim 17, wherein said secondary air passage and said tertiary air passage are radially spaced from each other.

19. A burner according to claim 17, further comprising means for swirling the air flowing through said secondary air passage and means for swirling the air flowing said tertiary air passage.

20. A burner according to claim 1, wherein said first recirculation flow-forming means comprises an annular flat plate portion disposed perpendicular to a direction of flow of said mixture and a tubular portion flaring from an outer peripheral edge of said annular flat plate portion in the direction of flow of said mixture.

21. A pulverized coal combustion burner comprising a pulverized coal passage through which a mixture containing pulverized coal and air flows;

an air passage through which additional air is supplied to a flow of said mixture from outside;

a wall separating said pulverized coal passage from said air passage;

first recirculation flow-forming means provided at a downstream end of said wall for forming recirculation flows of said mixture and said additional air;

a separation wall provided within said pulverized coal passage for dividing said mixture flow into two straight flows; and second recirculation flow-forming means for forming recirculation flows of said mixture downstream of a downstream end of said separation wall, said second recirculation flow-forming means being constituted by an end surface of said separation wall extending perpendicular to said straight flows, a thickness of the end surface of said separation wall in a direction perpendicular to said straight flows being not less than 10 mm.

22. A burner according to claim 21, in which a radial inner edge portion of the end surface of said separation wall is recessed.

23. A burner according to claim 21, in which said pulverized coal passage has a circular transverse cross-section, and said separation wall has an annular transverse cross-section.

24. A burner according to claim 21, in which said pulverized coal passage has a rectangular transverse cross-section, and said separation wall has a flat plate-like configuration.

25. A burner according to claim 21, in which said air passage comprises a secondary air passage annularly surrounding said pulverized coal passage, and a tertiary air passage provided outside of said secondary air passage.

26. A burner according to claim 25, in which said secondary air passage and said tertiary air passage are radially spaced from each other.

27. A burner according to claim 25, in which said first recirculation flow-forming means comprises an annular flat plate portion disposed perpendicular to the direction of flow of said mixture, and a tubular portion flaring from an outer peripheral edge of said annular flat plate portion in a direction of flow of said mixture.

28. A burner according to claim 25, in which one of said two straight flows contains the coal/air mixture containing a relatively large amount of coarse pulverized coal, while the other straight flow contains the coal/air mixture containing a relatively large amount of fine pulverized coal.

29. A burner according to claim 28, in which a maximum particle size of the coal contained in said one straight flow of the coal/air mixture containing a large amount of coarse pulverized coal is 300 μm, at least 50% of the total amount of said coal in said one straight flow has a particle size of not more than 75 μm, a maximum particle size of the coal contained in said other flow of the coal/air mixture containing a large amount of fine pulverized coal is 300 μm, at least 50% of the total amount of said coal in said other straight flow has a particle size of not more than 20 μm, and at least 80% of the total amount of said coal in said other straight flow has a particle size of not more than 53 μm.

30. A pulverized coal combustion burner comprising:

a pulverized coal passage through which a mixture containing pulverized coal and air flows;

an air passage for supplying additional air to a flow of said mixture from outside;

a wall separating said pulverized coal passage from said air passage;

first recirculation flow-forming means provided at a downstream end of said wall for forming recirculation flows of said mixture and said additional air;

a separation wall provided within said pulverized coal passage for dividing a flow of the mixture into two straight flows; and second recirculation flow-forming means for forming recirculation flows of said mixture downstream of a downstream end of said separation wall, one of said two straight flows of the mixture contains a relatively large amount of coarse pulverized coal, while the other straight flow contains a relatively a large amount of fine pulverized coal, said device further comprising a coarse pulverizer and a fine pulverizer, wherein one of said straight flows is in communication with said coarse pulverizer while the other straight flow is in communication with said fine pulverizer.

31. A burner according to claim 30, in which said second recirculation flow-forming means is constituted by an end surface of said separation wall extending perpendicular to said straight flows, and a thickness of the end surface of said separation wall in a direction perpendicular to said straight flows is not less than 10 mm.

32. A pulverized coal combustion burner comprising:

a pulverized coal passage through which a mixture containing pulverized coal and air flows;

an air passage for supplying additional air to a flow of said mixture from outside;

a wall separating said pulverized coal passage from said air passage;

first recirculation flow-forming means provided at a downstream end of said wall for forming recirculation flows of said mixture and said additional air;

a separation wall provided within said pulverized coal passage for dividing a flow of the mixture into two straight flows; and second recirculation flow-forming means for forming recirculation flows of said mixture downstream of a downstream end of said separation wall, one of said two straight flows of the mixture contains a relatively large amount of coarse pulverized coal, while the other straight flow contains a relatively a large amount of fine pulverized coal, said device further comprising a coal pulverizer for pulverizing coal, and a classifier for classifying the pulverized coal fed from said coal pulverizer, wherein the pulverized coal from said classifier which contains a relatively large amount of coarse coal particles is fed to said one straight flow, while the pulverized coal from said classifier which contains a relatively large amount of fine coal particles is fed to said other straight flow.

33. A burner according to claim 32, in which said second recirculation flow-forming means is constituted by an end surface of said separation wall extending perpendicular to said straight flows, and a thickness of the end surface of said separation wall in a direction perpendicular to said straight flows is not less than 10 mm.

34. A pulverized coal combustion burner comprising:

a pulverized coal passage through which a mixture containing pulverized coal and air flows;

an air passage for supplying additional air to a flow of said mixture from outside;

a wall separating said pulverized coal passage from said air passage;

first recirculation flow-forming means provided at a downstream end of said wall for forming recirculation flows of said mixture and said additional air;

a separation wall provided within said pulverized coal passage for dividing a flow of the mixture into the straight flows; and second recirculation flow-forming means for forming recirculation flows of said mixture downstream of a downstream end of said separation wall, said air passage comprising a secondary air passage annularly surrounding said pulverized coal passage and a tertiary air passage provided outside said secondary air passage; said burner further comprising means for swirling the mixture flowing in said pulverized coal passage and means for converting said swirling mixture into a straight flow and said pulverized coal passage having a circular transverse cross-section, said separation wall having an annular transverse cross-section, said mixture flow being divided into two concentric straight flows, and said converting means having plate-like members extending radially between said wall separating said pulverized coal passage from said air passage and said separation wall.

35. A burner according to claim 34, in which said plate-like members extend radially inwardly from said partition wall.

36. A burner according to claim 34, in which a dimension of said plate-like member in a direction of flow of said coal/air mixture is not less than 5 times larger than a dimension of said plate-like member in the radial direction.

37. A burner according to claim 34, in which said plate-like members extend radially outwardly from said separation wall.

38. A burner according to claim 34, further comprising a coal pulverizer for pulverizing coal into fine particles having a particle size of not more than 300 μm, said coal pulverizer being in communication with said pulverized coal passage.

39. A burner according to claim 38, further comprising a classifier for classifying the pulverized coal from said coal pulverizer into first and second groups of pulverized coal, wherein at least 50% of the pulverized coal in said first group has a particle size of not more than 75 μm, and at least 50% of the pulverized coal in said second group has a particle size of not more than 20 μm, and at least 80% of the pulverized coal in said second group has a particle size of not more than 53 μm.

40. A burner according to claim 34, in which said swirl means for swirling the coal/air mixture has a plurality of opening through which said mixture is supplied, said openings being disposed in a direction of the swirl.

41. A burner according to claim 34, in which said swirl means for swirling the coal/air mixture has a plurality of opening through which said mixture is supplied, said openings being disposed in a direction of the swirl.

42. A burner according to claim 34, further including an intervenient member disposed in said pulverized coal passage and upstream of said separation wall, said intervenient member cooperating with said pulverized coal passage to define therebetween a first passage portion, an area of which is gradually decreasing, a second passage portion, an area of which is constant, and a third passage portion, an area of which is gradually increasing, said passage portions being arranged in order along the flow of said coal/air mixture, and in which said swirl means is located in said second passage portion.

43. A burner according to claim 34, in which said separation wall has an outer peripheral surface, a diameter of which is gradually increasing and then becomes a constant along the flow of the said coal/air mixture.

* * * * *